United States Patent [19]

Owen

[11] Patent Number: 4,770,238

[45] Date of Patent: Sep. 13, 1988

[54] CAPILLARY HEAT TRANSPORT AND FLUID MANAGEMENT DEVICE

[75] Inventor: James W. Owen, Huntsville, Ala.

[73] Assignee: The United States of America as represented by the Administrator of the National Aeronautics and Space Administration, Washington, D.C.

[21] Appl. No.: 67,844

[22] Filed: Jun. 30, 1987

[51] Int. Cl.[4] ..... F28D 15/02

[52] U.S. Cl. ..... 165/104.26; 165/104.14; 122/366

[58] Field of Search ..... 165/104.26, 907, 104.14; 122/366

[56] References Cited

U.S. PATENT DOCUMENTS

| | | | |
|---|---|---|---|
| 3,811,493 | 5/1974 | Bilinski et al. | 165/104.26 |
| 4,196,504 | 4/1980 | Eastman | 165/104.26 |
| 4,422,501 | 12/1983 | Franklin et al. | 165/104.26 |
| 4,470,451 | 9/1984 | Alario et al. | 165/104.26 |
| 4,627,487 | 12/1986 | Basiulis | 165/104.26 |

*Primary Examiner*—Albert W. Davis, Jr.
*Attorney, Agent, or Firm*—William J. Sheehan; John R. Manning; Leon D. Wofford, Jr.

[57] ABSTRACT

A passive heat transporting and fluid management apparatus including a housing in the form of an extruded body member having flat upper and lower surfaces is disclosed. A main liquid channel and at least two vapor channels extend longitudinally through the housing from a heat input end to a heat output end. The vapor channels have sintered powdered metal fused about the peripheries to form a porous capillary wick structure. A substantial number of liquid arteries extend transversely through the wicks adjacent the respective upper and lower surfaces of the housing, the arteries extending through walls of the housing between the vapor channels and the main liquid channel and open into the main liquid channel. Liquid from the main channel enters the artery at the heat input end, wets the wick and is vaporized. When the vapor is cooled at the heat output end, the condensed vapor refills the wick and the liquid reenters the main liquid channel.

18 Claims, 2 Drawing Sheets

CAPILLARY HEAT TRANSPORT AND FLUID MANAGEMENT DEVICE

ORIGIN OF THE INVENTION

The invention described herein was made by an employee of the U.S. Government and may be manufactured and used by or for the Government for Government purposes without the payment of any royalties thereon or therefor.

BACKGROUND OF THE INVENTION

This invention relates to apparatus for transporting heat efficiently by means of a liquid/vapor or two-phase transport system, and more particularly to apparatus of this type in which the liquid is transported or distributed bi-dimensionally along separate and intersecting distribution channels, the distribution channels in one direction extending through porous wicks disposed in respective vapor distribution channels, the apparatus providing a low pressure loss geometric configuration which in conjunction with the substantial pressure head permitted by the wick and the large surface area available provides very high heat transport capacity.

Thermal control in, for example, spacecraft has been provided through the use of several types of heat transport systems, these being either an active control system or a passive control system. An active thermal control system requires some type of fluid being pumped through the components of the system. In spacecraft of the prior art such fluid systems were of the single phase heat transport types wherein a liquid is heated as it passes through the heat sources and rises in temperature, and thereafter gives up heat in a heat sink, such as a spacecraft radiator, and drops in temperature. For a large system with high heat loads the liquid flow rate must be substantial, and such large flow rates require large pumps which, of course, utilize large amounts of electrical power which is a critical resource of spacecraft systems. This is a major deficiency of the single phase active thermal control system, but additionally, the liquid will generally also have a large temperature gradient between the heat sources and the heat sink. One of the advantages of this system is that it can operate under gravitational forces in addition to the near zero gravity environment of a low earth orbit.

Other thermal control systems developed for spacecraft utilize a passive system theory. For example, a heat pipe utilizes the latent heats of vaporization and condensation of the liquids and vapors. A typical heat pipe has a circular cross sectional configuration and along its length has an evaporator section and a condenser section separated by a substantially adiabatic section. A porous capillary wick is disposed within the pipe intermediate the axis and the body thereof. The vapor flows through the central portion of the pipe in one direction from the evaporator to the condenser while liquid flows in the opposite direction by the action of the capillary forces created by the wick. Heat is added in the evaporator section of the pipe which causes liquid contained within the porous wick to evaporate. The vapor, due to a locally high vapor pressure, flows through the pipe toward the condenser section where heat is removed and the vapor condenses in the wick material. The liquid in the wick material is transported by the capillary forces associated with the wick toward the evaporator section. Since the liquid evaporates and the vapor condenses at substantially the same temperature, very small temperature gradients exist between the heat source and the heat sink. Additionally, since the latent heat of vaporization for most fluids is large, very small mass flow rates are required to transport significant amounts of heat from the source to the sink. Moreover, since the mass transport occurs passively due to the action of capillary forces, no electrical energy is required to operate the heat pipe. However, although they are very efficient devices and are quite effective in the microgravity environment of low earth orbit where capillary forces can predominate, heat pipes are ineffective under the gravitational forces on earth where the small capillary forces cannot predominate.

In an effort to overcome the capillary pressure limitations of heat pipe systems, yet retain the inherent advantages of two-phase transport systems, several concepts are presently under study for future systems. One such concept uses a pump on the liquid side of the system for pumping the liquid to the heat sources, the liquid being metered through control valves prior to entry through the heat source evaporators. The control valves operate to meter the liquid so that it completely evaporates to vapor at the exit of the evaporators. The vapor then passes to the heat sink radiator elements where it condenses, and the liquid is then subcooled prior to entering the inlet of the pump. Although pumped two-phase thermal bus systems are envisioned as having high heat transport capacities with small power consumption, the process is no longer passive, as in a heat pipe, but must be actively designed, monitored and controlled. Thus, the major drawback appears to be in the complexity of the engineering technology required to ensure proper management of the liquid and vapor, especially in microgravity conditions.

Another concept for heat transport, known as a capillary pumped loop, which is described in NASA publication TM X-1310, Nov. 1966, utilizes a capillary device only in the evaporator. Heat is added to the evaporator and the vapor generated is forced to flow in one direction from the capillary pump, the vapor acting to force all the mass to flow through the system. Condensation occurs in the cooler sections of the loop and the liquid is pushed back to the inlet of the evaporator through a perforated conduit about which the wick is disposed. The liquid thereby wets the porous capillary plug and when heated is vaporized. Although the capillary pumped loop operates well under microgravity conditions, it also has limited ability for operating under gravitational forces. Additionally, the capillary pumped loop is sensitive to pressure loss in the condenser duct and the liquid returned to the evaporator must be slightly subcooled for operation to be maintained.

Thus, each of the known prior art heat transport systems for moving heat from heat sources to heat sinks for use in spacecraft has limitations which reduce their utility for such application. To summarize, the single phase, pumped liquid system requires a high power consuming pump; the passive heat pipe systems have limited heat transport capacity; the actively pumped two-phase thermal bus concept, although having large heat transport capacity, is overly complex; while the capillary pumped loop system, which although is passive and has improved capacity over heat pipes, is sensitive to pressure loss and subcooling. Additionally, in each of the two-phase systems the preferred working fluid is ammonia, which has high toxicity.

SUMMARY OF THE INVENTION

Consequently, it is a primary object of the present invention to provide a two-phase passive system for efficiently transporting heat between one or more heat sources to one or more heat sinks utilizing a safe working fluid while obtaining a high heat transport capacity by optimizing the mass transport phenomena of the system.

It is another object of the present invention to provide a two-phase thermal transport system for efficiently transferring heat between thermal interface devices with a small temperature gradient, the system being operable under the microgravity environment of space as well as normal earth gravity.

It is a further object of the present invention to provide a capillary fluid management device for transferring heat efficiently in a liquid/vapor mass transport device, the device having multi-dimensional liquid distribution passageways, a plurality of such passageways extending transversely to at least one main liquid channel and through the porous capillary wick structure of vapor distribution passageways.

Accordingly, the present invention provides a fluid management system for transporting heat from a heat source to a heat sink by means of heat transporting apparatus wherein liquid is distributed with low pressure loss in bi-directional passageways, at least one main liquid passageway extending in substantially the same direction as vapor passageways having wick material on the walls thereof, and a multiplicty of other liquid passageways extending transversely to the main liquid and the vapor passageways, the transverse passageways each having a substantially small cross sectional size relative to the main liquid passageway and being formed through the wick material in the vapor passageways. The liquid resides in the main passageway, the transverse passageways and the wick, and the vapor resides in the vapor passageways.

The heat transporting appartus includes a housing geometrically configured to include planar or flat plate surfaces so as to present large surface areas to heat transfer interface devices for transfer of heat into the evaporator section and from the condenser section.

The wick material is disposed about the peripheral surfaces of the vapor passageways, and the transverse liquid passageways distribute the liquid in the wick. Heat transferred to the wick in the evaporator results in evaporation of the liquid at the liquid/vapor interface and the resulting locally high vapor pressure effects flow of the vapor through the vapor passageways toward the condenser where the vapor condensers on the wick surfaces, fills the wick and transverse liquid passageways, and by the action of the generated pressure gradients flows into the main liquid passageway and back to the evaporator section where the liquid again enters the transverse liquid passageways and the wick.

The configuration and operation of the fluid management and heat transporting apparatus is adaptable to a wide variety of heat transport systems and thermal interface devices, and may be readily manufactured using conventional manufacturing processes.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
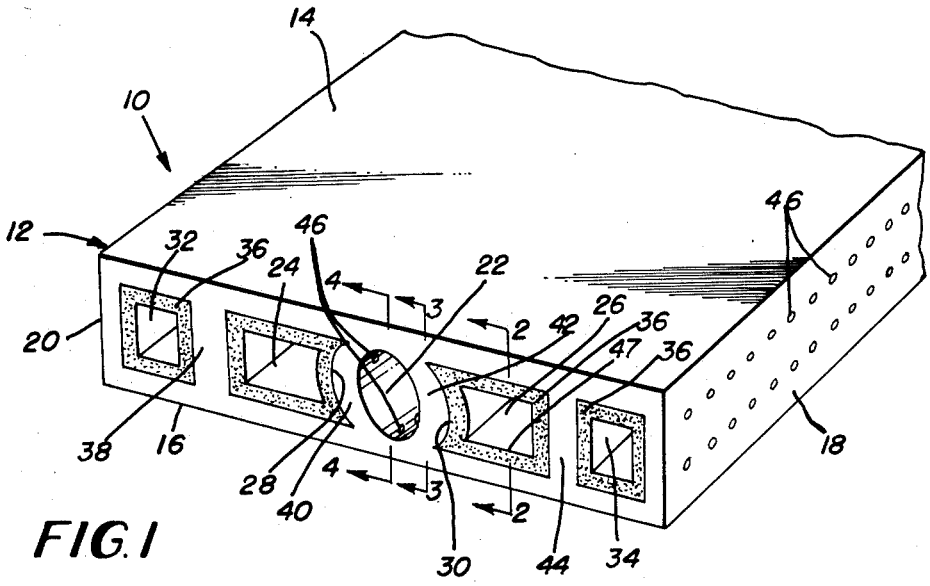
FIG. 1 is a fragmentary perspective view of the preferred embodiment of a fluid management device for transporting heat constructed in accordance with the principles of the present invention.
Figure 2:
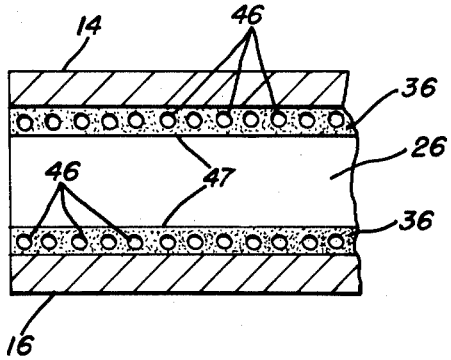
FIG. 2 is a cross sectional view taken substantially along line 2—2 of FIG. 1.
Figure 4:
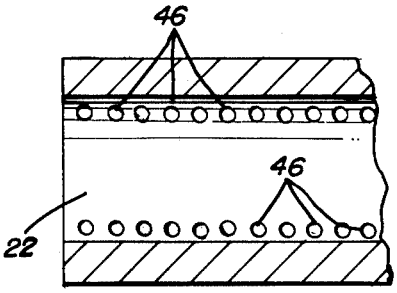
FIG. 4 is a cross sectional view taken substantantially along line 4—4 of FIG. 1.
Figure 3:
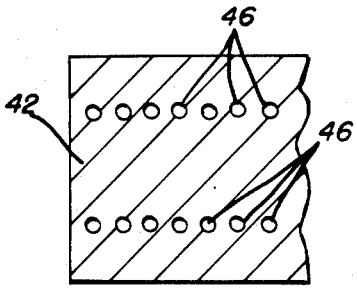
FIG. 3 is a cross sectional view taken substantially along 3—3 of FIG. 1.

Referring now to the drawings, FIG. 1 illustrates the preferred form of a fluid management device 10 of the present invention for transporting heat between evaporator and condenser sections of the device. The device 10 comprises a housing 12 preferably having substantially flat heat conducting top and bottom plate surfaces 14, 16 which, as envisioned for a compact unit, may be spaced apart by an amount in the order of approximately 0.7 inch (1.778 cm.) while the width of the housing 12 between side walls 18, 20 typically may be in the order of approximately 12 inches (30.5 cm.). Longitudinally the device may be of any convenient length as determined by the system application for which it will be utilized.

Disposed intermediate the surfaces 14, 16 and extending in the longitudinal direction of the housing is a main liquid channel 22 and preferably at least two vapor passageways 24, 26 spaced at opposite sides of the main channel 22 and preferably having arcuate borders 28, 30 adjacent the main liquid channel 22. In the preferred embodiment illustrated in FIG. 1 there are four vapor passageways, the additional two passageways 32, 34 being spaced apart and respectively disposed adjacent a respective passageway 24, 26 and remote from the liquid channel 22. The thickness of the plate surfaces 14, 16 typically may be in the order of 0.1 inch (0.254 cm.) and a sintered metal wick 36 of a thickness in the order of 0.15 inch (0.381 cm.) is fixedly disposed about the periphery of each of the vapor passageways. Thus, the height of the openings or channels in the vapor passageways is in the order of approximately 0.2 inch (0.508 cm.). Transversely extending through ribs 38, 40, 42, 44 of the housing intermediate the respective passageways and main liquid channel are a multiplicity of spaced apart liquid distribution arteries 46. The liquid arteries 46 extend through the wick material 36 in the vapor passageways adjacent the plate surfaces 14 and 16 and open into the main liquid channel 22. These liquid arteries 46 typically may have a diameter of approximately 0.05 inch (0.127 cm.) and are disposed throughout the entire length of the device 10. All of the aforesaid dimensions are envisioned as typical and may vary for a device designed for optimum performance in a particular application, and thus these dimensions should not be considered as limitations of the invention. The longitudinal ends of the device may be closed by plates, panels or manifolds as required by the particular system application for which it is to be used.

In constructing the device 10 the housing 12 may be formed from an aluminum extrusion with the main liquid channel 22 and the vapor passageways therein separated by the ribs 38, 40, 42, 44, the thickness of the ribs preferably being sized for structural stiffness and/or for receiving bolts for mounting purposes in various applications. Thereafter, the liquid distribution arteries may be formed by drilling through the side walls 18, 20 adjacent the surfaces 14, 16 through the respective ribs so as to open into the channel 22. Mandrels of a size substantially equal to the eventual vapor channel opening are positioned through the vapor passageways and supported spaced from the periphery of the passageways. Additionally, mandrels in the form of rods may be inserted through the holes forming the transverse distribution arteries and passed through vapor passageways. Thereafter the spaces about the vapor channel mandrels are filled with a conventional powered aluminum compound metal and the assembly is placed in a furnace which is then brought up to sintering temperature. After the powdered metal is sintered the assembly is cooled and all the mandrels are removed. The transverse hole openings in the side walls 18, 20 are thereafter plugged by welds or the like, and plates, panels or manifolds may be fastened to the longitudinal ends of the housing as necessary for the particular system application. Prior to charging with liquid, the apparatus may be vacuum baked to minimize contaminants.

Because of the bi-directional flow of liquid through the device, the device can be configured with substantially flat surfaces 14 and 16. Since most heat transfer apparatus have flat surfaces, the device of the present invention permits a large surface area to be interfaced with the various subassemblies in, for example, a spacecraft. A high heat transport capacity can be obtained with sintered particles having conventional capillary pore size in the wick structure, e.g., $10^{-3}$ to $10^{-7}$ meters For example, sintered particles having radii in the range of 1.0 to 10.0 micro-meters ($10^{-6}$ to $10^{-5}$ meters), capillary pressure gradients may be generated in the range of 1.0 to 10.0 psi ($6.9\times10^{3}$ to $6.9\times10^{4}$ newtons/m$^2$) for standard working fluids. This is a substantial pressure head in comparison to conventional heat pipes, and coupled with the low pressure loss geometric configuration, appears to provide a very high heat transport capacity For example, whereas the conventional heat pipe technology has demonstrated capacities in the range of 15 killowatt-meters (heat capacity transported through a length of heat pipe), and the capillary pumped loop system has demonstrated capacities in the range of 65 killowatt-meters, the projected capacity for the apparatus of the present invention is in the order of 600 killowatt meters for similar operating conditions and non-toxic working fluids.

Figure 5:
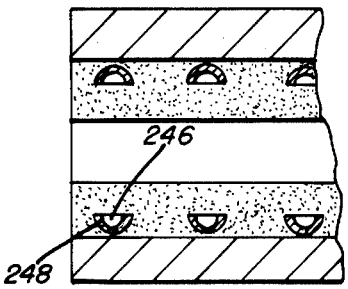
FIG. 5 is a view similar to FIG. 2, but illustrating a modification of the configuration of the transverse liquid distribution passageways.
Figure 6:
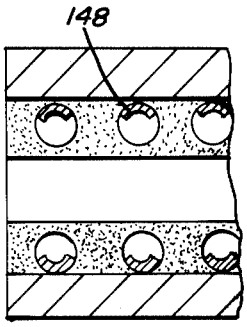
FIG. 6 is a view similar to FIG. 2, but illustrating a further modification in the configuration of the transverse liquid distribution passageways.

The operation of the device is similar to that of a heat pipe. As aforesaid, the liquid, which because of the reduced pressure losses in the system and the higher available heat transport capacities, may be relatively safe working fluids compared to the ammonia utilized in prior art systems It is envisioned that halogenated hydrocarbon fluids, such as FREON 11 ® and FREON 113 ®, acetone and other substantially non-toxic working fluids may be utilized. The liquid resides in the liquid channel 22, the transverse liquid distribution arteries 46, and in the porous wick 36. The vapor resides in the vapor channels 24, 26, and in any additional vapor channels such as the channels 32 and 34 illustrated in FIG. 1. One portion of the longitudinal length of the device illustrated in FIG. 1 is the evaporator section while the other longitudinal end of the device is the condenser section. When heat is added to either or both plate surfaces 14, 16 in the evaporator section, the heat is transfered by conduction through the wall to the wick and to the liquid-to-vapor interface 47. In order to retard heat flow so that vaporization is avoided near the artery-to-plate interface, insulation in the form of teflon material may be positioned adjacent the artery to plate interface. FIG. 5 illustrates the utilization of such insulating material 148 adjacent the artery-to-plate interface. A similar concept is illustrated in FIG. 6 wherein the insulating material 248 is depicted in arteries 246 having semicircular cross sectional configurations. Similarly, insulation may be applied to the channel 22.

The heat which is transferred to the wick liquid-to-vapor interface 47 effects evaporation of the liquid resulting in a locally high vapor pressure. The increase in vapor pressure causes the vapor to move longitudinally along the vapor channels toward the condenser section. When the vapor is sufficiently cooled in the condenser section, condensation occurs on the wick surface. The small pressure difference between the vapor and the liquid, forces the liquid to fill the wick 36 and the liquid distribution arteries 46. The slight pressure gradients which arise from the initial vapor pressure distribution results in the liquid flowing from the transverse liquid arteries in the condenser section into the main longitudinal liquid channel 22, from where it flows back to the evaporator section of the device. The liquid then fills the transverse liquid arteries along the wick to complete the cycle.

Because of the bi-directional flow of liquid, i.e., through the arteries 46 and through the main liquid channel 22, the liquid can wet the entire wick structure without the large pressure losses associated with conventional heat pipe systems. The bi-directional liquid distribution and return systems and the capillary pressure gradients generated permits a relatively large amount of fluid to be moved through the system and thus a large amount of heat to be transported. As opposed to conventional heat pipes wherein the pressure losses can prevent the liquid from reaching the evaporator section and wetting the wick therein, the present invention by having the liquid flow in the main channel 22 into the evaporator section to fill the transverse arteries in the wick ensures that the wick in the evaporator section is wet so that evaporation with the attendent locally high vapor pressures effect a flow of the liquid through the system.

The principles of the present invention may be applied to a wide variety of heat transport systems and thermal interface devices. Examples of such possible applications include heat pipe evaporators, condensers, cold plates for removing heat from a component of a system for cooling the component, radiator fins for radiating heat from a space vehicle to space, as could heat exchangers, and various capillary pumped systems. Two such applications are illustrated in FIGS. 7 and 8.

Figure 7:
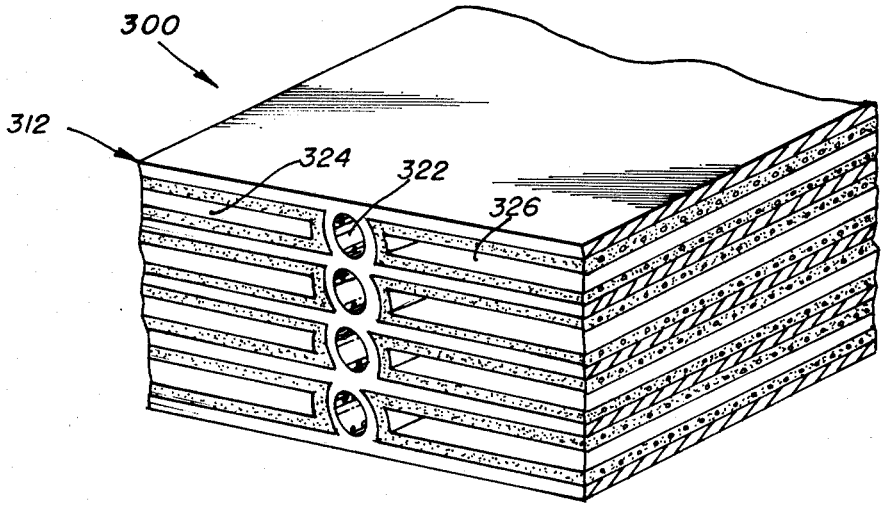
FIG. 7 is a fragmentary perspective view of a heat exchanger constructed in accordance with the principles of the fluid management system of the present invention.

In FIG. 7 a heat exchanger 300 is depicted which is constructed utilizing the two phase bi-directional distribution concept. As illustrated, a plurality of basic heat transporting units may be stacked in the unitary housing 312 to provide a compact heat exchanger. Although not illustrated, the several main liquid channels 322 may be manifolded together as may the various vapor channels 324, 326. Utilizing such a design large amounts of heat may be transferred through the unit.

Figure 8:
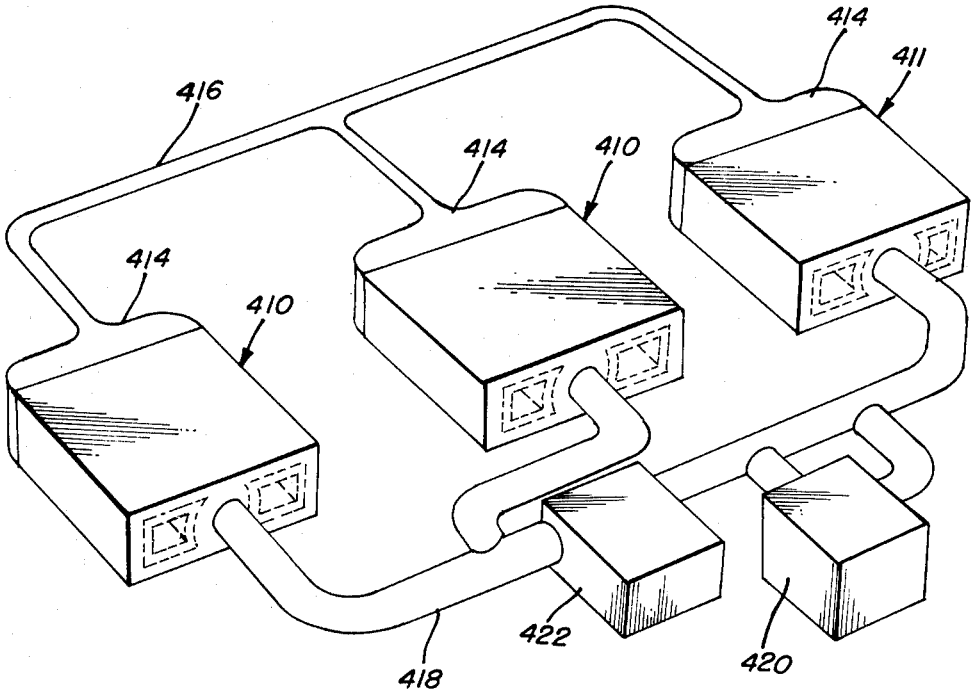
FIG. 8 is a diagrammatic perspective view of an application of the principles of the present invention to a capillary pumped heat transporting system wherein separate evaporators and condensers are utilized.

In FIG. 8 a capillary pumped system utilizing a pair of evaporators 410 and a condenser 411 is illustrated. The vapor channels are closed off at one end of the units and are connected together in flow communication by manifolds 414 interconnected together by vapor lines 416 at the other ends. The liquid channels likewise communicate with each other by means of liquid conduits 418 at the opposite ends of the units. The liquid may be directed through a fluid accumulator 420 to account for changes in fluid volume due to changes in temperature and also for controlling the temperature. Additionally, the liquid may flow through a getter 422 for removing residual gas which may be in the liquid. Heat may be added to the evaporators and the vapor generated in the wick fills the vapor channels and flows through the line 416 toward the condenser manifold. Heat is removed in the condenser and condensation occurs. The liquid in the wick enters the liquid channel and is forced to flow from the liquid channel in the condenser back to the liquid channels in the evaporators. The liquid in the transverse arteries ensures that the wicks in the evaporators remain wet even under one gravity conditions.

It can thus be seen that the present invention significantly improves two phase transport phenomena, thermal interfaces and system integration features. The flat surfaces of the housings not only provide large surface areas for heat transfer, but also permit easy integration of such units into spacecraft systems and subsystems, and have application to several types of devices. The large liquid and vapor channels minimize viscous pressure losses in the longitudinal direction. Liquid is distributed in the wick by the low pressure loss transverse liquid distribution arteries. Permeability losses in the wick itself are minimized due to the large surface area, short flow paths and small flow rates in the wick. The wick structure permits relatively high thermal conductivity and the mass transport capabilities can be maximized by using a small pore size wick structure. Additionally, relatively safe working fluids may be utilized in the apparatus. Devices constructed in accordance with the present invention may be readily manufactured using standard and proven manufacturing techniques.

Numerous alterations of the structure and methods of fabricating the same herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention, what is claimed herein, is:

1. Apparatus for transporting heat passively from a heat source to a heat sink, said apparatus comprising a longitudinally extending housing, a first elongated channel extending longitudinally through said housing for transporting a working fluid in the liquid phase therethrough, second channel means formed in said housing and extending longitudinally therethrough spaced from said first channel by rib portions of said housing, said second channel means defined by peripheral wall surfaces, a porous capillary wick formed on the peripheral wall surfaces of said second channel means, said wick extending only partially into said channel means to provide a central unobstructed longitudinal passageway therethrough for flow of said working fluid in the vapor phase, and a multiplicity of liquid distribution arteries formed transversely entirely though said wick and said rib portions and opening into said first channel but not opening into said central passageway of said second channel means, said liquid distribution arteries being spaced along the longitudinal extent of said housing for receiving liquid from said first channel for wetting said wick at one end of said housing and for supplying liquid to said first channel at the other end of said housing.

2. Apparatus as recited in claim 1, wherein said second channel means comprises at least a pair of channelways, each channelway having a respective wick disposed about the peripheries thereof and providing a central passageway, said first channel being disposed intermediate said second channelways.

3. Apparatus as recited in claim 1, wherein said housing comprises external top and bottom surfaces, said top and bottom surfaces being substantially flat planar surfaces for interfacing in abutting relationship with other apparatus having substantially flat planar surface.

4. Apparatus as recited in claim 3, wherein said second channel means comprises at least a pair of channelways, each channelway having a respective wick disposed about the peripheries thereof and providing a central passageway, said first channel being disposed intermediate said second channelways.

5. Apparatus as recited in claim 1, wherein one longitudinal end of each of said first channel and said second channel means are closed.

6. Apparatus as recited in claim 2, wherein one longitudinal end of said second channelways are connected together in flow communication by a manifold.

7. Apparatus as recited in claim 1, including a plurality of said housings, means for connecting one longitudinal end of said first channel of the housings together in flow communication, and means for connecting one longitudinal end of said second channel means of the housings together in flow communication.

8. Apparatus as recited in claim 1, wherein said housing comprises a plurality of first channels disposed adjacent to each other in substantially parallel relationship, and a plurality of second channel means disposed adjacent each other in substantially parallel relationship, the liquid distribution arteries of each second channel extending transversely through the wicks in respective second channels and opening into a respective first channel.

9. Apparatus as recited in claim 1, wherein said liquid distribution arteries include insulation disposed transversely through said wick on surfaces thereof adjacent said housing remote from said passageway.

10. Apparatus as recited in claim 1, wherein said housing comprises a solid body member having said first channel and said second channel means formed therein, and said rib portions comprise portions of said body member.

11. Apparatus as recited in claim 10, wherein said second channel means comprises at least a pair of channelways, each channelway having a respective wick disposed about the peripheries thereof and providing a central passageway, said first channel being disposed intermediate said second channelways.

12. Apparatus as recited in claim 11, wherein said housing comprises external top and bottom surfaces, said top and bottom surfaces being substantially flat planar surfaces for interfacing in abutting relationship with other apparatus having substantially flat planar surface.

13. Apparatus as recited in claim 12, wherein one longitudinal end of each of said first channel and said channelways is closed.

14. Apparatus as recited in claim 13, wherein said porous capillary wick comprises sintered metal particles.

15. Apparatus as recited in claim 14, wherein the sintered metal particles of said wick have capillary pore dimensions in the range of $10^{-3}$ to $10^{-7}$ meters.

16. Apparatus as recited in claim 1, wherein said porous capillary wick comprises sintered metal particles.

17. Apparatus as recited in claim 16, wherein the sintered metal particles of said wick have capillary pore dimensions in the range of $10^{-3}$ to $10^{-7}$ meters.

18. Apparatus for transporting heat passively from a heat source to a heat sink, said apparatus comprising a longitudinally extending metallic body member having substantially flat planar spaced apart surfaces to define upper and lower surfaces of said apparatus for transfer of heat therethrough, one end of said body member being defined as a heat receiving evaporator section and the opposite end being defined as aheat dissipating condenser section, a first elongated channel extending longitudinally through said body member from said evaporator section to said condenser section for transporting a working fluid in liquid phase therethrough, a pair of second channels formed in said body member and extending therethrough from said evaporator section to said condenser section at opposite transverse sides from said first channel and spaced therefrom by wall portions of said body member, said second channels having peripheral wall surfaces including sintered metal particles defining respective porous capillary wicks, a multiplicity of longitudinally spaced liquid distribution arteries formed transversely through the respective wick adjacent the upper and lower surfaces of said body member, said arteries extending through respective wall portions and opening into said first channel, means for enclosing the lateral ends of said channels for maintaining working fluid in said apparatus, said liquid distribution arteries being spaced along the longitudinal extent of said body member for receiving said fluid in the liquid phase from the first channel in the evaporator section for wetting said wicks and for supplying said fluid to the first channel in the liquid phase in the condenser section.

* * * * *